United States Patent [19]

Inoue

[11] 4,130,448

[45] Dec. 19, 1978

[54] HIGH-PERMEABILITY MAGNETIC ALLOY

[75] Inventor: Kiyoshi Inoue, Tokyo, Japan

[73] Assignee: Inoue-Japax Research Incorporated, Yokohama, Japan

[21] Appl. No.: 850,004

[22] Filed: Nov. 9, 1977

Related U.S. Application Data

[63] Continuation of Ser. No. 694,969, Jun. 11, 1976, abandoned.

[30] Foreign Application Priority Data

Jun. 12, 1975 [JP] Japan ..... 50/70129

[51] Int. Cl.[2] ..... C22C 38/02; C22C 38/04

[52] U.S. Cl. ..... 148/31.57; 75/124; 148/101

[58] Field of Search ..... 75/124; 148/101, 31.57

[56] References Cited

U.S. PATENT DOCUMENTS

| | | | |
|---|---|---|---|
| 2,193,768 | 3/1940 | Masumoto et al. | 75/124 |
| 2,801,942 | 8/1957 | Nachman | 75/124 |
| 2,859,143 | 11/1958 | Nachman et al. | 75/124 |
| 2,988,806 | 6/1961 | Adams et al. | 75/124 |
| 2,992,474 | 7/1961 | Adams et al. | 75/124 |

FOREIGN PATENT DOCUMENTS

| | | | |
|---|---|---|---|
| 45-19571 | 6/1966 | Japan | 75/124 |

*Primary Examiner*—Arthur J. Steiner
*Attorney, Agent, or Firm*—Karl F. Ross

[57] ABSTRACT

A rollable or plastically deformable Sendust-type magnetic alloy containing by weight 3 to 8% aluminum, 4 to 8% silicon, 0.1 to 1% niobium or tantalum or mixtures thereof and the balance iron. The alloy is especially suitable for use with high-frequency inputs.

1 Claim, 2 Drawing Figures

(WITH 0.5% Nb)

(WITHOUT Nb)

HIGH-PERMEABILITY MAGNETIC ALLOY

This is a continuation of application Ser. No. 694,969, filed June 11, 1976, now abandoned.

FIELD OF THE INVENTION

The present invention relates to a high-permeability magnetic alloy and, more particularly, to an improved aluminum/silicon/iron magnetic alloy composition.

BACKGROUND OF THE INVENTION

The aluminum/silicon/iron alloy containing by weight 4 to 8% aluminum, 6 to 11% silicon and the balance iron is called commonly Sendust and is known as an excellent "soft" magnetic material having a high permeability, a desirable hardness and a large electric resistivity.

Because of these characteristics, it is highly suitable, for instance, as magnetic head core materials, especially with high-frequency inputs and where wear resistance is important. Because of its hardness and brittleness, however, this alloy has the disadvantage that it is not plastically machinable. For this reason, the practice used heretofore to fabricate flakes of the Sendust alloy is to mechanically slice a cast ingot of the alloy into pieces and then to grind each piece into a desired thickness. Because of the brittleness of the alloy, however, the slicing and finishing procedure unavoidably gives rise to chipping and, as a consequence, the yield of satisfactory products has been relatively low.

Another method practiced is to comminute a cast ingot into a powder of a particle size, say, in the order of 10 microns and then to compact a mass of the powder with a binder under application of a pressure which must be as high as 18 to 21 tons/cm$^2$ to obtain a desired product of the alloy. These procedures, too, are relatively complicated and have made the products expensive.

OBJECTS OF THE INVENTION

It is, therefore, the object of the present invention to provide an improved aluminum/silicon/iron (Sendust-type) magnetic alloy whereby the above-mentioned difficulties are overcome.

A more specific object of the invention is to provide an improved magnetic alloy of the type defined and which is malleable and rollable.

SUMMARY OF THE INVENTION

In accordance with the present invention, there is provided an improved magnetic alloy containing by weight 3 to 8% aluminum, 4 to 8% silicon, 0.1 to 1% niobium or tantalum or a combination of both and the balance iron. Preferably, the content of iron ranges between 85 and 92%. It has been found that the incorporation of a niobium component (i.e. the niobium alone or in combination with tantalum) into the base alloy system in which aluminum and silicon contents have somewhat lower proportions than the conventional Sendust alloy composition is highly effective to render the alloy malleable and rollable without decreasing the effective permeability thereof to high-frequency currents.

SPECIFIC DESCRIPTION AND EXAMPLE

Details of the invention will now be described with reference to embodiments thereof.

Table 1 shows magnetic properties and degrees of malleability of various conventional aluminum/silicon-/iron alloy compositions and Table 2 shows such alloy compositions incorporating 0.5% by weight niobium, all these alloy compositions being prepared by the conventional casting procedure. In both Tables, those marked "excellent" in the malleability column of represent alloy compositions which could be rolled with a reduction of the cross-section thereof of nearly 100% whereas "bad" indicates alloy compositions which were incapable of rolling as a consequence of the formation of cracks therein after one or two to five passes of rolling operation. Those marked "good" were alloy compositions whose rollability was found to be between the above two.

Figure 2:
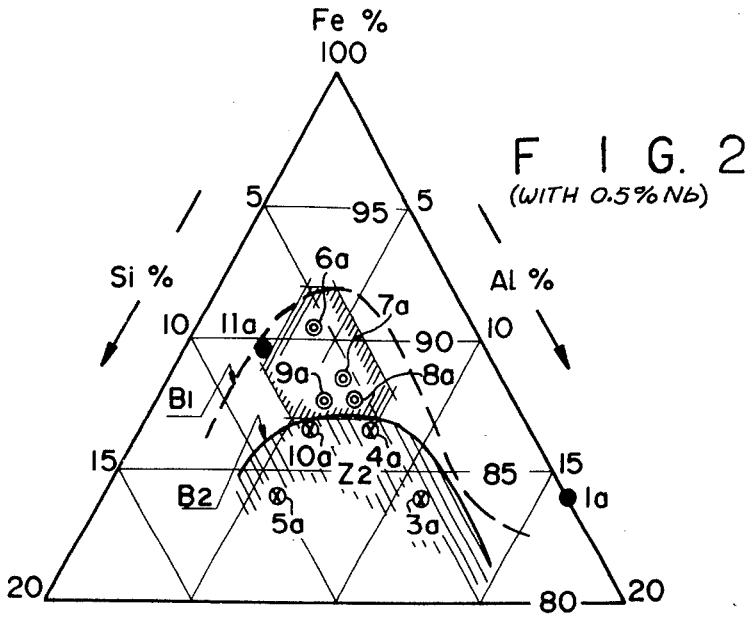
FIGS. 1 and 2 are composition graphs illustrating aspects of the invention.
Figure 1:
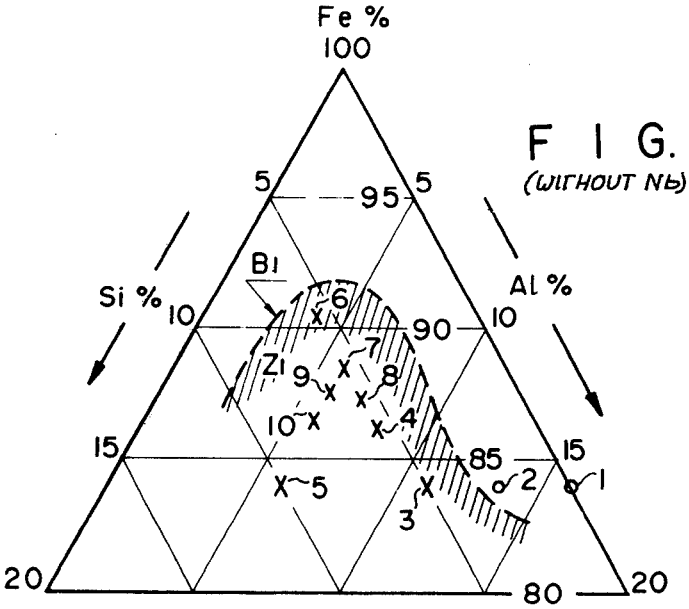

In the accompanying drawings, FIG. 1 is a composition diagram showing mallebilities of conventional aluminum/silicon/iron compositions shown in Table 1, and FIG. 2 is a similar diagram showing a shift of the malleable limit line B, with the aluminum/silicon/0.5% niobium/iron compositions shown in Table 2.

In the FIGURES, alloy compositions shown in Table 1 and which are rollable are marked with a circle and alloy compositions which are not rollable are marked with a cross, each together with the corresponding sample number. Further, a curve B1 shown by a broken line represents the line of malleable limit defining therebelow the region of compositions Z (higher aluminum and higher silicon) which are not even hot-rollable.

More specifically, it is seen that only two compositions in Table 1, viz. the sample No. 1 which represents a binary aluminum/iron alloy known as Al16 or Alperm and the sample No. 2 which is a ternary alloy containing 13.5% aluminum, 2.5% silicon and the balance iron are rollable. All other sample ternary compositions with a thickness of 10 mm in Table 1 were cracked after 1 to 5 passes of hot rolling operation at a temperature of 1000° to 1300° C. with each pass causing a reduction of cross section or thickness of 0.1 to 0.2 mm and became incapable of rolling.

The composition diagram of FIG. 2 indicates that with the addition of niobium there is a shift of the malleable limit line B1 to the position of B2 so that the rollable composition zone is extended. Sample compositions marked with a cross-inclusive circle which are incapable of rolling are seen to distribute in a zone with higher aluminum and silicon and not greater than 87% iron. Sample compositions marked with a double circle in the same FIGURE which are rollable are also seen from Table 2 to exhibit high-frequency characteristics comparable with those of the conventional Sendust. It is further seen that the sample composition marked with a blacked circle is inferior in magnetic properties although rollable.

Further experimentation has demonstrated that when the addition of niobium is less than 0.1% by weight, no substantial displacement of the malleable limit line takes place and that when the amount of niobium is in excess of 1% by weight, adverse effects on magnetic properties are increased although the rollable zone is extended. It has also been observed that the rollable zone of compositions is located in a lower aluminum and lower silicon region with a lesser addition of niobium and is extended to include a region of higher aluminum and higher silicon as the added amount of niobium is increased. The proportion of iron for the alloy to be rollable is found to be in excess of 92% by weight with the addition of niobium being nil, in excess of 90% by weight with the addition of niobium being 0.1 to 0.2% by weight, in excess of 87% by weight with the addition of niobium being 0.5% by weight and in excess of 85% by weight with the addition of niobium being 0.8 to 1.0% by weight. Within the above-mentioned rollable compositin zone, further an optimum composition zone is found in which 3 to 8% by weight aluminum and 4 to 8% by weight silicon are included enabling the alloy compositions to have good high-frequency responsive effective permeabilities.

It is seen that the alloy compositions of sample No. 6*a* through No. 9*a* lie within this optimum zone and especially No. 7*a* exhibits much higher effective permeability than the conventional Sendust for inputs of 100 KHz and 4 MHz, although it is somewhat inferior for inputs in a low-frequency range.

It is also seen that the hardness of the alloy compositions according to present invention remains as high as 479 to 574 Vickers hardness, thus holding the wear-resistance property of the alloy excellent.

Although the invention has been described in places with reference to the addition of niobium alone to the aluminum/silicon/iron base alloy, it should be noted that the niobium component specified may be so reworded that it contains 0 to 99% by weight tantalum and the balance niobium. More specifically, niobium and tantalum in nature co-exist in affinity and have similar physical and chemical properties to each other. In fact, the niobium material in the described embodiments of the invention contain 2 to 3% by weight tantalum and the balance niobium. At present, it is quite expensive to obtain purer niobium or tantalum either than the afore-mentioned. It has been confirmed that substantially same results are obtained using a tantalum material containing several % by weight niobium. Accordingly, the possible incorporation of niobium in the claims as 0.1 to 1% by weight also means 0.1 to 1% by weight of a combination of niobium and tantalum.

Table 1

| Sample No. | Weight Proportion % Al | Si | Nb | Rolling Procedure: Rolling Temp. °C | Reduction of cross-section (mm/pass) × (passes) | Reduction rate % | Malleability |
|---|---|---|---|---|---|---|---|
| 1 | 16 | 0 | 0 | 1100 | 0.125 × 5 → 0.5 ×2 | 40 | Good |
| 2 | 13.5 | 2.5 | 0 | 1200 | 0.1 × 100 | 91.6 | Excellent |
| 3 | 11 | 5 | 0 | 1200 | 0.1 × 8 | — | bad |
| 4 | 8 | 5.5 | 0 | 1200 | 0.1 | — | bad |
| 5 | 6 | 10 | 0 | 1000 | 0.125 × 3 | — | bad |
| 6 | 4 | 5.5 | 0 | 1200 | 0.1 × 2 | — | bad |
| 7 | 6 | 5.5 | 0 | 1300 | 0.2 × 1 | — | bad |
| 8 | 7 | 5.5 | 0 | 1300 | 0.1 × 1 | — | bad |
| 9 | 6 | 6.5 | 0 | 1200 | 0.1 × 2 | — | bad |
| 10 | 6 | 7.5 | 0 | 1200 | 0.1 × 2 | — | bad |

| Sample No. | Magnetic Properties: Initial permeability μi | Maximum permeability μm | Coercive force Ho(Oe) | Residual flux density Br (G) | Effective permeability 4KHz | 100 KHz | μeff 4 MHz | Hardness | Remarks |
|---|---|---|---|---|---|---|---|---|---|
| 1 | 3,000 | 55,000 | 0.04 | | | | | | Alperm |
| 2 | | | | | | | | | |
| 3 | | | | | | | | | |
| 4 | | | | | | | | | |
| 5 | 30,000 | 120,000 | 0.2 | | 3,600 | 550 | 60 | 574 | Sendust |
| 6 | | | | | | | | | |
| 7 | | | | | | | | | |
| 8 | | | | | | | | | |
| 9 | | | | | | | | | |
| 10 | | | | | | | | | |

Note 1)
The thickness of samples before rolling : about 4 to 12mm (not constant).
Note 2)
The reduction of cross-section (thickness) in each rolling pass : (thickness before each pass) - (rolling gap)
Note 3)
Reduction rate : (initial thickness-final thickness)/(initial thickness) × 100%
Note 4)
(Conditioning heat treatment : Sample 1 was quenched from 600° C and the others were gradually cooled from 1000° C for 1 hour Table 2

| Sample No. | Weight Proportion % Al | Si | Nb | Rolling Procedure: Rolling Temp. °C | Reduction of cross-section (mm/pass) × (passes) | Reduction rate % | Malleability |
|---|---|---|---|---|---|---|---|
| 1a | 16 | 0 | 0.5 | 1100 | 0.1 | — | Good |
| 3a | 11 | 5 | 0.5 | 1200 | 0.1 | — | bad |
| 4a | 8 | 5.5 | 0.5 | 1200 | 0.1 | — | bad |
| 5a | 6 | 10 | 0.5 | 1200 | 0.1 | — | bad |
| 6a | 4 | 5.5 | 0.5 | 1200 | 0.1 × 20 →0.15 × 10→0.1 × 15 | 84.2 | Excellent |
| 7a | 6 | 5.5 | 0.5 | 1200 | 0.15 × 10→0.1 × 35 | 84.6 | Excellent |
| 8a | 7 | 5.5 | 0.5 | 1200 | 0.15 × 20→0.1 × 26 | 84.1 | Excellent |
| 9a | 6 | 6.5 | 0.5 | 1200 | 0.1 × 55→0.15 × 10→0.1 × 85.2 | Excellent | |
| 10a | 6 | 7.5 | 0.5 | 1200 | 0.1 × 7 | — | bad |

Table 2-continued

| | | | | | | | | | | |
|---|---|---|---|---|---|---|---|---|---|---|
| 11a | 2.7 | 7.8 | 0.5 | 1200 | 0.1 × 10→0.15 × 20→0.1 × 25 | | | 85.7 | Excellent | |

| Sample No. | Initial permeability μ i | Maximum permeability μ m | Coercive force Ho(Oe) | Residual flux density Br(G) | Effective permeability 4KHz | Effective permeability 100KHz | μeff 4MHz | Hardness Hv | | Remarks |
|---|---|---|---|---|---|---|---|---|---|---|
| 1a | | | | | | | | | | |
| 3a | | | | | | | | | | |
| 4a | | | | | | | | | | |
| 5a | | | | | | | | | | |
| 6a | 450 | 8,000 | 0.40 | 4300 | 2040 | 397 | 63 | 479 | | Product according to the present invention |
| 7a | 650 | 9,500 | 0.27 | 5200 | 3451 | 583 | 75 | 497 | | |
| 8a | 300 | 1,150 | 0.84 | 2000 | 3060 | 518 | 55 | 495 | | |
| 9a | 300 | 5,100 | 0.35 | 4300 | 3000 | 500 | 45 | 574 | | |
| 10a | | | | | | | | | | |
| 11a | 0 | 500 | 0.86 | 825 | | | | 574 | | |

I claim:

1. A magnetic alloy body which has been rolled to reduce its thickness by at least 84.1% and consisting by weight essentially of 3 to 8% aluminum, 4 to 8% silicon, 0.1 to 1% of a component containing at least one element selected from the group which consists of niobium and tantalum and the balance iron in an amount of 85 to 92% by weight.

* * * * *